United States Patent [19]

Creed et al.

[11] 4,385,574

[45] May 31, 1983

[54] THREAD GUIDING AND HOLD-DOWN PAWL FOR BOBBIN WINDING MECHANISM OF A SEWING MACHINE

[75] Inventors: Gerald J. Creed, Rahway; Charles R. Odermann, Montville, both of N.J.

[73] Assignee: The Singer Company, Stamford, Conn.

[21] Appl. No.: 265,290

[22] Filed: May 20, 1981

[51] Int. Cl.[3] ..... D05B 59/00

[52] U.S. Cl. ..... 112/184; 112/279

[58] Field of Search ..... 112/181, 184, 223, 229, 112/231, 279

[56] References Cited

U.S. PATENT DOCUMENTS

| | | | |
|---|---|---|---|
| 2,299,524 | 10/1942 | Chason | 112/231 |
| 3,407,760 | 10/1968 | Ketterer | 112/184 |
| 3,693,565 | 9/1972 | Ketterer | 112/184 |
| 3,693,566 | 9/1972 | Ketterer | 112/184 |
| 4,326,474 | 4/1982 | Zylbert | 112/184 |

*Primary Examiner*—Wm. Carter Reynolds

*Attorney, Agent, or Firm*—William V. Ebs; Robert E. Smith; Edward L. Bell

[57] ABSTRACT

A control arm for bobbin winding mechanism in a lock-stitch sewing machine is provided with a pawl which serves both to guide needle thread into a thread entering slot for a tensioning device on a bobbin case, and to hold an arm of the tensioning device in a position effective to prevent the thread from being pulled out of the slot.

6 Claims, 13 Drawing Figures

Fig. 1
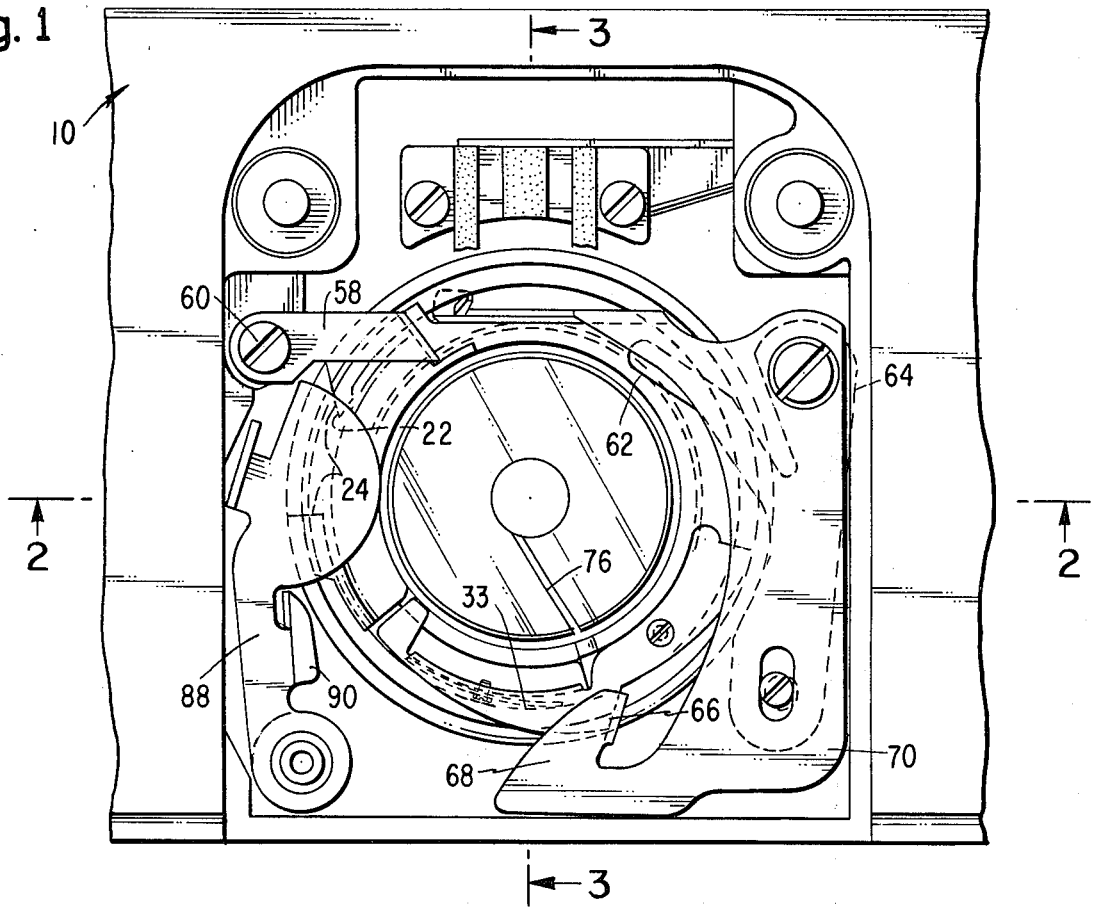
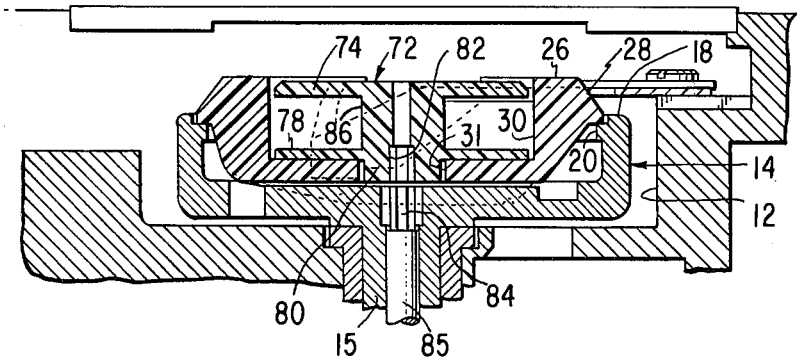
Fig. 2
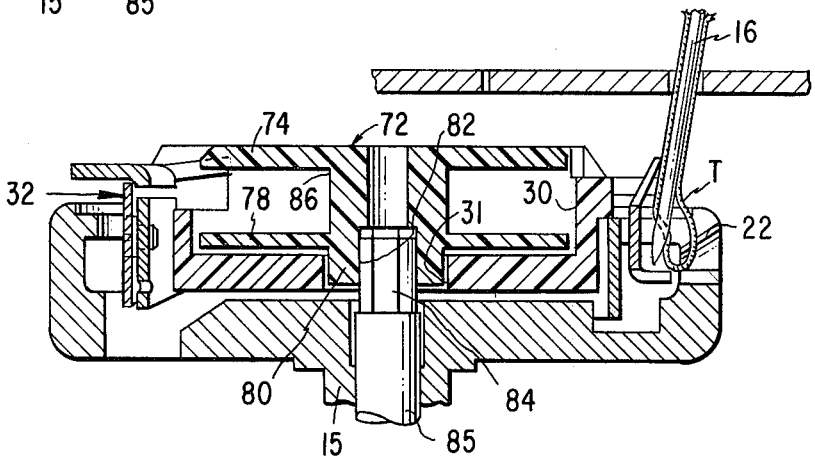
Fig. 3

Fig. 4
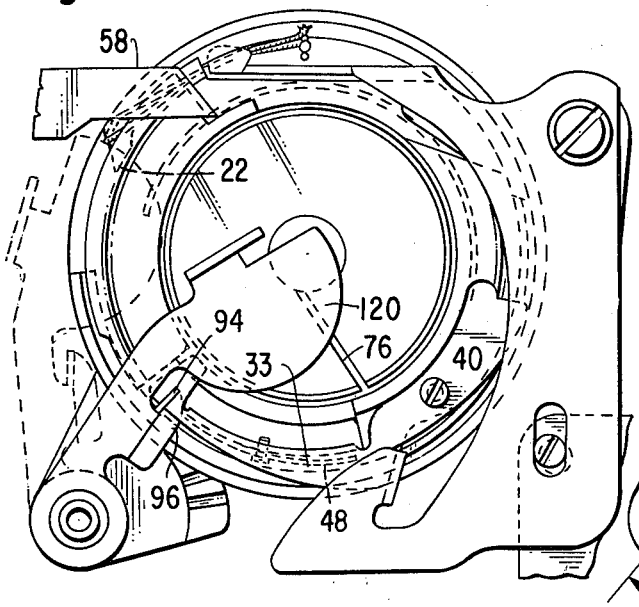
Fig. 5
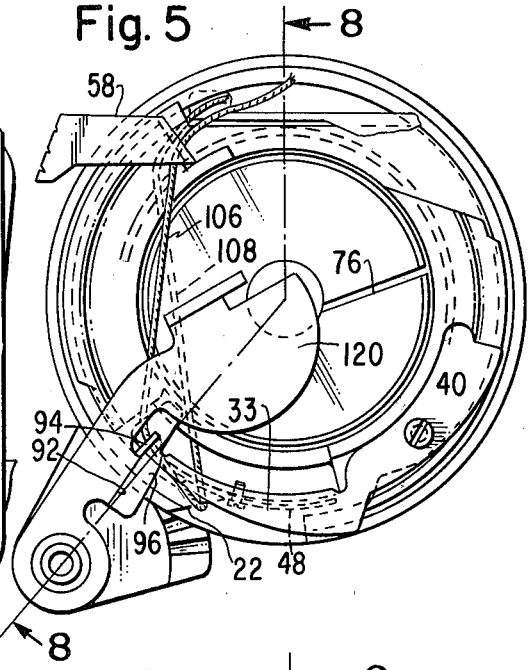
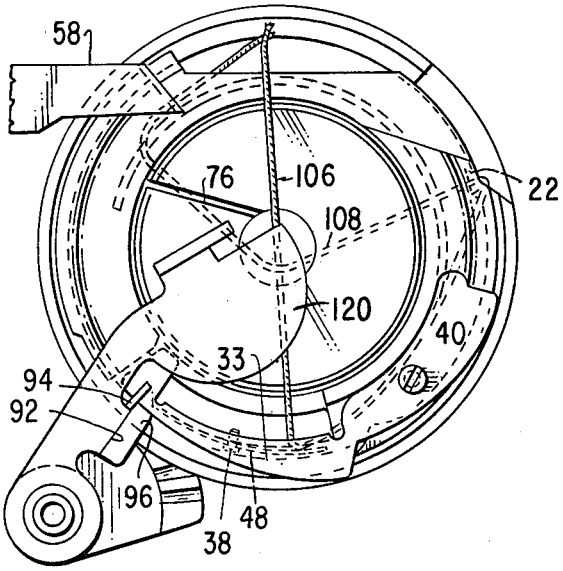
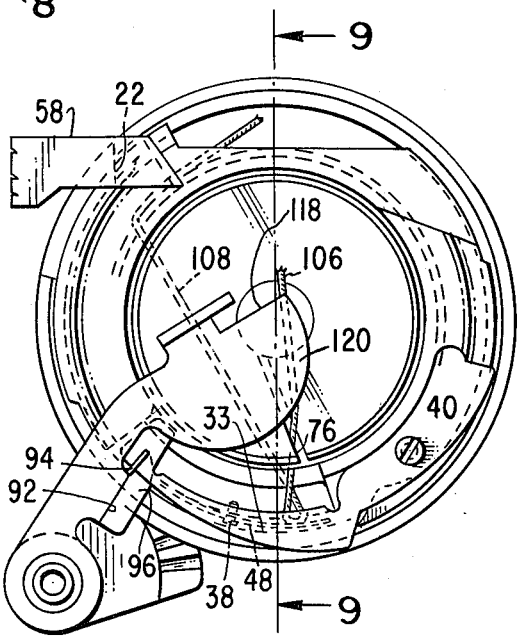
Fig. 6
Fig. 7
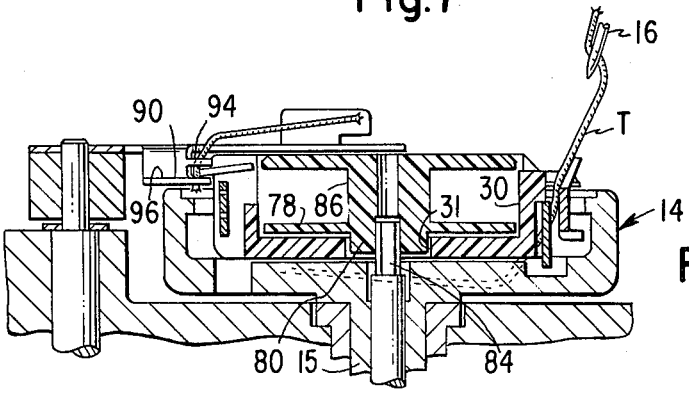
Fig. 8

Fig. 9
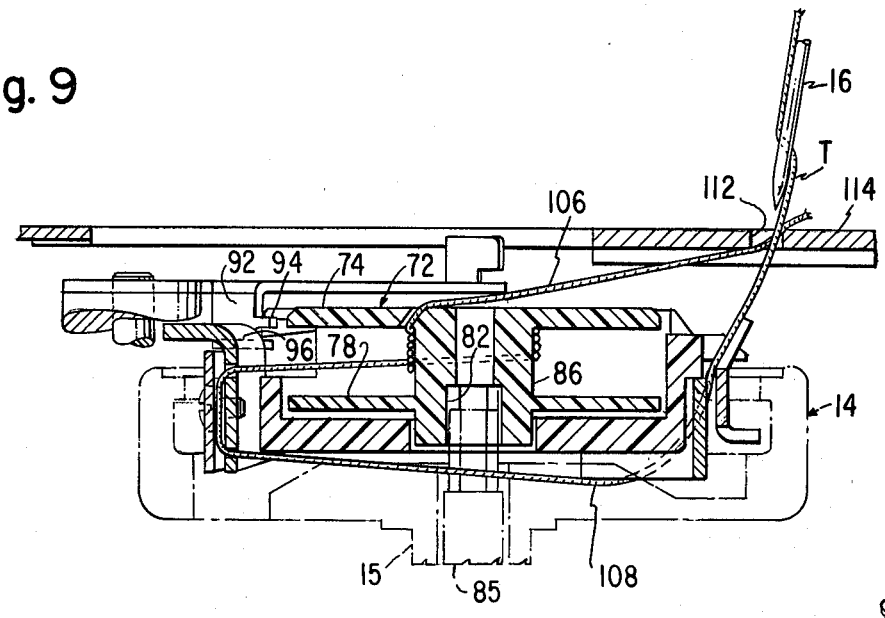
Fig. 10
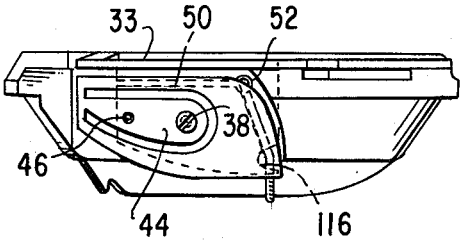
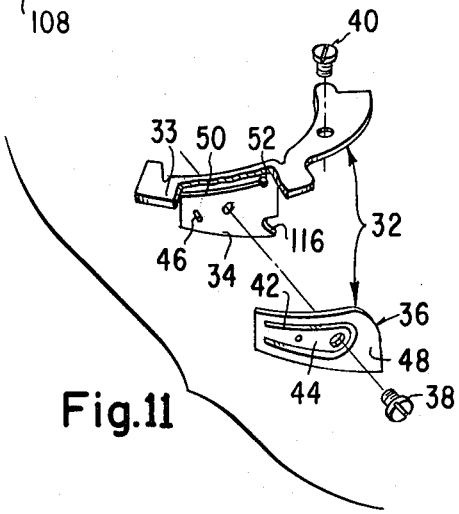
Fig.11
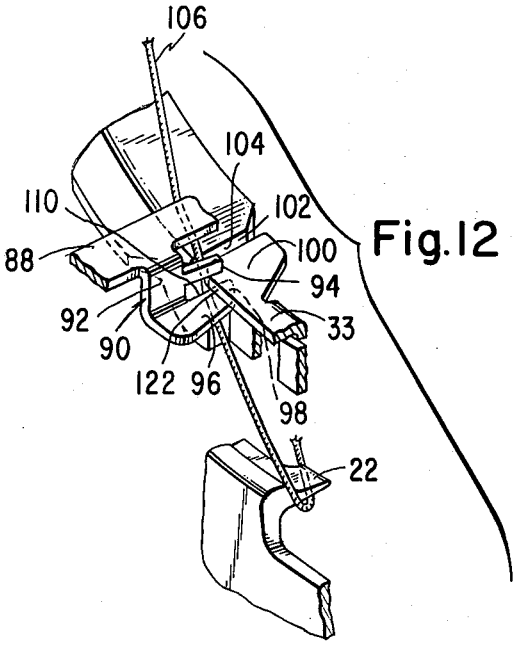
Fig.12
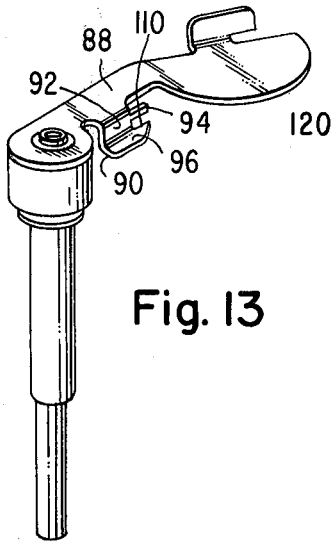
Fig. 13

THREAD GUIDING AND HOLD-DOWN PAWL FOR BOBBIN WINDING MECHANISM OF A SEWING MACHINE

BACKGROUND OF THE INVENTION

1. Field of the Invention

The invention relates to arrangements for introducing needle thread which is to be wound on the bobbin of a lockstitch sewing machine into a bobbin case slot leading to thread tensioning means.

2. Description of the Prior Art

U.S. Pat. No. 3,693,566 of The Singer Company issued Sept. 26, 1972 discloses bobbin replenishing mechanism for a lockstitch sewing machine. Such mechanism includes a thread engageable finger that is provided for the purpose of guiding needle thread, which is to be wound upon a bobbin, into a bobbin case slot leading to a thread tensioning device. The thread is moved along the finger and into the mouth of the slot as a seized loop of the thread is moved about the bobbin case by the looptaker, and is supposed to be moved down the slot into the tensioning device by continued motion of the looptaker. However, it sometimes happens that the thread is pulled out of the mouth of the slot after leaving the finger and is caused to move across the slot. As a consequence, the thread fails to enter the tensioning device and the winding of thread onto the bobbin is prevented.

A copending U.S. patent application of The Singer Company, Ser. No. 265,506, filed May 20, 1981 discloses a thread engageable finger which is intended to delay the movement of thread along a thread engaging edge thereof until the full introduction of thread into a bobbin case slot and movement of the thread into a tensioning device is assured. The present invention is directed to the use in bobbin winding mechanism of a uniquely fashioned pawl effective to guide thread without delay to a bobbin case slot and to then entrap the thread in the slot by blocking any possible movement thereof out of the slot so as to assure passage of the thread by way of the slot into a thread tensioning device.

It is a prime object of the invention to provide a simply structured easily fashioned pawl which can be used effectively both to guide needle thread, which is to be wound upon a bobbin into a bobbin case slot leading to a thread tensioning device and to entrap the thread in the slot until moved to the tensioning device.

Other objects and advantages of the invention will become apparent during a reading of the specification taken in connection with the accompanying drawings.

SUMMARY OF THE INVENTION

In accordance with the invention, bobbin replenishing mechanism of the kind disclosed in U.S. Pat. No. 3,693,566 is provided with a thread controlling pawl which serves to direct thread to be wound upon a bobbin into a bobbin case slot, and to entrap the thread therein until moved into a thread tensioning device carried by the bobbin case. The pawl carries a pair of cooperating fingers. One finger enters into engagement with the underside of an arm of the tensioning device at the mouth of the bobbin case slot and has a thread guiding edge thereon for leading thread into the slot. The other finger overlies and engages the arm of the tensioning device to prevent the thread from lifting the arm, and escaping from the slot.

DESCRIPTION OF THE DRAWINGS

FIG. 1 is a top plan view showing a looptaker in the bed of a sewing machine together with mechansim for constraining a bobbin case in the looptaker, and with a thread controlling pawl according to the invention as disposed by a control arm during a sewing operation;

FIG. 2 is a fragmentary sectional view taken on the plane of the line 2—2 of FIG. 1;

FIG. 3 is a fragmentary sectional view taken through the looptaker on the plane of the line 3—3 of FIG. 1, and showing needle thread which is to be wound on a bobbin at the time of seizure by the looptaker;

FIGS. 4, 5, 6 and 7 are top plan views showing the thread controlling pawl as disposed for bobbin winding, and showing the looptaker in various positions during initial stages of a bobbin winding operation;

FIG. 8 is a sectional view taken on the plane of the line 8—8 of FIG. 5;

FIG. 9 is a sectional view taken on the plane of the line 9—9 of FIG. 7;

FIG. 10 is an elevational view of the bobbin case illustrating the needle thread in a thread tensioning device during a bobbin winding operation;

FIG. 11 is an exploded perspective view of the thread tensioning device;

FIG. 12 is a perspective view showing a fragment of the bobbin case and illustrating the function of the thread controlling pawl of the invention; and FIG. 13 is a perspective view of the thread controlling pawl.

DESCRIPTION OF THE INVENTION

Referring to the drawings, reference character 10 designates a portion of a sewing machine bed including an upwardly open cavity 12 wherein looptaker 14 is accommodated for rotation by a hollow shaft 15. The looptaker cooperates with an endwise reciprocatory needle 16 to provide for the formation of lockstitches in a manner well understood in the art, and as fully described in U.S. Pat. No. 3,693,565 of Stanley J. Ketterer for "Lockstitch Loop Takers for Sewing Machines" issued Sept. 26, 1972.

As shown, the looptaker 14 has an upwardly open cup-shaped form. The looptaker includes a rim 18, and an annular inwardly projecting shoulder 20 which forms a needle thread loop seizing beak 22 at a lateral opening 24.

A bobbin case 26 is supported within the cup-shaped form of the looptaker where a bobbin case bearing flange 28 rests upon looptaker shoulder 20. The bobbin case is formed with an upwardly open bobbin accommodating cavity 30 through the bottom of which a large central aperture 31 extends.

The bobbin case 26 carries a thread tensioning device 32 including a support arm 33, a downturned arm 34, and a thread tensioning spring 36 which is secured by a screw 38 to the downturned arm 34. A screw 40 extending through support arm 33 secures the tensioning device to the bobbin case. The spring 36 is formed with a slot 42 in the form of a U-shaped loop separating a tongue 44 through which the screw 38 and a locating pin 46 on arm 34 pass. Surrounding the tongue 44 is another spring blade portion 48 which frictionally engages thread in the device 32 against the downturned arm 34 to apply tension to the thread. The downturned arm 34 is formed with a thread entry slot 50 which as shown in FIGS. 10 and 11, terminates in an eyelet 52 for directing thread to the spring blade portion 48 of spring 36.

A member 58 which rests in a shallow recess in the bobbin case flange 28 and is secured to the machine bed by a screw 60 serves to restrain rotation of the bobbin case 26 in the machine bed 10. A hold down spring arm 62 which extends from a bed mounted base plate 64, and a rotation restraining lip 66 on an arm 68 extending from a bed mounted base plate 70 provide additional restraint for the bobbin case.

A bobbin 72 is freely rotatable within the bobbin accommodating cavity 30 of the bobbin case 26. The bobbin includes a top flange 74 formed with an outwardly extending slot 76 skewed slightly from a true radial position on the top flange. The bobbin further includes a bottom flange 78 having a depending boss 80 which fits into the central aperture 31 of the bobbin case. Boss 80 is formed with a non-circular aperture 82 to match the non-circular extremity 84 of a driving spindle 85 located in hollow looptaker shaft 15. Between the flanges 74 and 78 of the bobbin, a plain cylindrical hub 86 is provided. The spindle is part of a bobbin thread replenishing mechanism as disclosed in U.S. Pat. No. 3,693,566 of Stanley J. Ketterer for "Bobbin Thread Replenishing Mechanism for Sewing Machines" issued Apr. 23, 1971. Such mechanism includes the control arm 88 which, as explained in said patent is movable between a position apart from the bobbin case (FIG. 1), and a position over the bobbin case and bobbin as shown in FIGS. 4, 5, 6, 7 and 9. As further explained in U.S. Pat. No. 3,693,566, when the arm 88 is disposed over the bobbin case and bobbin, the spindle 85 is raised to enter bobbin aperture 82, and the bobbin is then rotated with the looptaker to provide for the winding of needle thread T on the bobbin. Arm 88 includes as an integral part thereof, a pawl 90 constructed in accordance with the invention. The pawl includes an arm depending portion 92 with a finger extension 94, and further includes a finger 96 which extends perpendicularly from arm depending portion 92. In the position of control arm 88 for bobbin winding, pawl 90 is disposed to cause the tip 98 of finger 96 to extend into underlying engagement with the end portion 100 of tensioning device support arm 33 at a location adjacent a slot 102 between the said end portion and a shoulder 104 on the bobbin case, and to cause finger 94 to overlie and engage the end portion 100 of support arm 33.

During a bobbin winding operation, a needle thread presented by the needle 16 as in FIG. 3 for seizure by the beak 22 of looptaker 14, after having been picked up by beak 22, is moved as a loop by the looptaker about the bobbin case (FIG. 4) toward the finger 96, and one limb 106 of the loop is caused to move over the bobbin case, whereas the other limb 108 is moved under the bobbin case (FIG. 5). In the position of FIG. 5 and of FIG. 12, limb 106 is caused to engage a straight edge 110 on finger 96. Thread limb 106 is guided by such edge into the mouth of slot 102, and passes off the end of finger 96. As the looptaker continues to rotate, the thread is moved through tensioning device slot 50 to a position wherein the thread extends through eyelet 52 and between downturned arm 34 and spring blade portion 48 of the tensioning device (FIGS. 6 and 10).

As rotation of the looptaker continues beyond the position shown in FIG. 6, the loop of needle thread is drawn off the looptaker beak 22 and, depending upon the position in which the bobbin happened to be when the spindle 85 was elevated, slot 76 in the top flange of the bobbin is moved past the free end of the needle thread loop extending from eyelet 52 over the bobbin 72 and to the needle aperture 112 in a throat plate 114. As the bobbin continues to turn with the looptaker, the limb of the needle thread which enters the bobbin through the slot is wrapped around the bobbin hub 86. As wrapping of the thread begins, slack is dissipated and the thread is drawn into a groove 116 in the thread tensioning device. The slot 76 is so skewed that the limb of thread extending to the throat plate is moved back and forth across an edge 118 formed on the blade 120 of the control arm 88. An abrading action of the thread on the edge 118 severs the thread after a number of rotations of the bobbin. The free end of the needle thread may then be withdrawn and discarded. Thereafter, continued rotation of the bobbin serves to wind replenishment thread on the bobbin for later use as bobbin thread in the formation of lockstitches. The replenishment thread is drawn into the bobbin in a path as indicated in FIG. 9 that proceeds from the path of reciprocation of the needle downwardly between the bobbin case 26 and looptaker base, between the thread tensioning spring blade 48 and downturned arm 34 of the tensioning device 32, and then into the bobbin.

Heretofore in an arrangement, as disclosed in U.S. Pat. No. 3,693,566, employing a thread guiding finger during a bobbin winding operation for directing needle thread to a bobbin case slot leading to a thread tensioning device, it was not unusual for the thread after passing off the end of a thread guiding finger to be pulled out of the mouth of the slot and to be thereby prevented from moving into the tensioning device. With pawl 90, the thread is retained in the slot by reason of the engaging relationship of finger 94 with the end of support arm 33, and can only move from the slot into the tensioning device as required for bobbin winding. Finger 94 holds the end of arm 33 down so that it cannot be lifted by the thread off finger 96 into a position permitting the thread to move outwardly from between finger 96 and arm 33, and to then jump over the edge 122 of the arm. In effect, the thread, after moving off finger 96 is entrapped in the slot 102 until moved in response to rotation of the looptaker through tensioning device slot to eyelet 52 and between downturned arm 34 and spring blade portion 48 of the tensioning device.

It is to be understood that the present disclosure relates to a preferred embodiment of the invention which is for purposes of illustration only and is not to be construed as a limitation of the invention. Numerous alterations and modifications of the structure herein will suggest themselves to those skilled in the art, and all such modifications and alterations which do not depart from the spirit and scope of the invention are intended to be included within the scope of the appended claims.

We claim:

1. In a lockstitch sewing machine, a cup-shaped circular moving looptaker including a peripheral rim formed with a thread seizing beak; a non-rotatable bobbin case supported in the looptaker; a rotatable bobbin within the bobbin case, an endwise reciprocable needle movable into a position for presenting a loop of needle thread to the looptaker beak for seizure; a thread tensioning device carried by the bobbin case and including an arm forming a thread entering slot for said device with a shoulder on the bobbin case; a bobbin winding control arm; a pawl movable by the control arm, the pawl including one finger disposable with the pawl into a position wherein the tip of the finger extends into engagement with the underside of an end portion of the arm of the thread tensioning device, and an edge of the finger is situated to guide a limb of a seized loop of needle thread into the slot for passage into the thread tensioning device, said pawl including another finger which in the thread guiding position of said one finger is in overlying engagement with the arm of the tensioning device and is effective to prevent the thread from lifting the arm and escaping from the slot; thread pick up means on the bobbin; and means responsive to movement of the control arm for rotating the bobbin to cause the bobbin to pick up and wind thread extending through the tensioning device onto the bobbin.

2. The combination of claim 1 wherein the thread engaging edge of said one finger is straight.

3. The combination of claim 1 wherein the pawl is part of the control arm.

4. The combination of claim 1 wherein the pawl is part of the control arm and said another finger is an extension on a portion of the pawl depending from the control arm.

5. The combination of claim 4 wherein the said one finger extends substantially perpendicularly from the depending portion of the pawl.

6. The combination of claim 5 wherein the thread engaging edge of the said one finger is straight.

* * * * *